US008398364B1

(12) United States Patent
Liang

(10) Patent No.: US 8,398,364 B1
(45) Date of Patent: Mar. 19, 2013

(54) TURBINE STATOR VANE WITH ENDWALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 506 days.

(21) Appl. No.: 12/840,641

(22) Filed: Jul. 21, 2010

(51) Int. Cl.
*F01D 25/12* (2006.01)

(52) U.S. Cl. ..... 415/115; 415/58.7; 415/116; 415/914; 416/193 A

(58) Field of Classification Search ..... 416/93 R, 416/97 R, 189, 193 A; 415/58.7, 115, 116, 415/191, 210.1, 914
See application file for complete search history.

(56) References Cited

U.S. PATENT DOCUMENTS 4,146,352 A * 3/1979 Yasugahira et al. ..... 415/144
6,719,529 B2 * 4/2004 Tiemann ..... 416/97 R
6,887,033 B1 * 5/2005 Phillips et al. ..... 415/115
7,097,417 B2 * 8/2006 Liang ..... 415/115
7,510,367 B2 * 3/2009 Liang ..... 415/115
7,621,718 B1 * 11/2009 Liang ..... 415/115
8,221,055 B1 * 7/2012 Liang ..... 415/115

* cited by examiner

*Primary Examiner* — Edward Look
*Assistant Examiner* — Liam McDowell
(74) *Attorney, Agent, or Firm* — John Ryznic

(57) ABSTRACT

A turbine stator vane with an airfoil extending from an endwall, a vortex flow retaining chamber formed within the endwall and wrapping around a leading edge region and opening onto a surface of the endwall in front of the leading edge region of the airfoil. A vortex flow tube is formed within the endwall and extends from one side to the opposite side of the endwall and passes through the vortex flow retaining chamber. Cooling air supply holes open into the vortex flow tube to produce a vortex flow in a direction opposite to a vortex flow of the hot secondary gas that flows into the vortex flow retaining chamber. A row of exit cooling holes are connected to the vortex flow tube and open onto the endwall surface to discharge the hot secondary flow that flows into the chamber and is mixed with the cooling air supplied through the supply holes.

7 Claims, 4 Drawing Sheets

TURBINE STATOR VANE WITH ENDWALL COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to a stator vane with endwall cooling.

2. Description of the Related Art Including Information Disclosed Under 37 CFR 1.97 and 1.98

A gas turbine engine, such as an industrial gas turbine (IGT) engine, a turbine includes one or more rows of stator vanes and rotor blades that react with a hot gas stream from a combustor to produce mechanical work. The stator vanes guide the gas stream into the adjacent and downstream row of rotor blades. The first stage vanes and blades are exposed to the highest gas stream temperatures and therefore require the most amount of cooling.

One major problem with the first stage stator vanes is erosion from hot spots that occur on certain locations around the vane leading edge fillet regions due to migration of the has gas stream. This erosion results in cracking of the metal or spallation of the TBC to expose the metal surface to the hot gas stream. FIG. 1 shows a hot gas stream flow pattern in a row of stator vanes. The hot flow core gas entering the turbine stator vanes is formed of a boundary layer 11 and a stream surface 12. The boundary layer 12 entering the row of vanes collides with the leading edge of the vane airfoil and forms a horseshoe vortex that separates into pressure side vortices 13 and suction side vortices 14. The pressure side (P/S) vortices 13 will flow downward and flow along the airfoil pressure side forward fillet region first. Due to the presence of hot flow channel pressure gradient from the pressure side to the suction side, the pressure side vortices 13 will migrate across the hot gas passage and end up flowing along the suction side of the adjacent vane. As the pressure side vortices 13 rolls across the hot flow channel, the size and strength of the pressure side vortices 13 becomes larger and stronger. Since the pressure side vortices 13 is much stronger than the suction side (S/S) vortices 14, the suction side vortices 14 will flow along the airfoil suction side fillet and function as a counter flow vortices for the pressure side vortices 13. The P/S vortices 13 and the S/S vortices 14 are counter rotating vortices.

FIG. 1 shows an isometric view of the stator vanes with the vortices formation for a boundary layer entering the turbine airfoil. As a result of these vortices flow phenomena, some of the hot core gas flow from the upper airfoil span flows toward a close proximity to the endwall and therefore creates a high heat transfer coefficient and a high gas temperature region at the airfoil fillet region.

As shown in FIG. 1, the resulting forces drive the stagnated flow that occurs along the airfoil leading edge towards the region of lower pressure at the intersection of the airfoil and endwall. This secondary flow flows around the airfoil leading edge fillet and endwall region. This secondary flow then rolls away from the airfoil leading edge and flows upstream along the endwall against the hot core gas flow. As a result, the stagnated flow forces acting on the hot core gas and radial transfer of hot core gas flow from the upper airfoil span toward close proximity to the endwall creates a high heat transfer coefficient and a high gas temperature region at the intersection location. For the endwall with film cooling and vortex flow within the flow channel, the vortex flow within the flow channel will degrade the film cooling effectiveness level.

Another effect on the vanes from the hot gas stream reacting with the leading edge of the vanes is shown in FIGS. 2 and 3. Besides the P/S and S/S vortices forming, a forward stagnated flow 15 forms along the leading edge adjacent to the inner endwall 22 and outer endwall 21 in which the hot gas flow flows back toward the oncoming hot gas stream. A secondary flow 16 along the fillet region on both the P/S and the S/S of the airfoil is also formed as represented by the arrows in FIG. 3. A downdraft secondary flow also appears on the stagnation point of the airfoil leading edge surface. An area of stagnation flow occurs in this region creates a high heat transfer coefficient and high gas temperature region.

BRIEF SUMMARY OF THE INVENTION

A turbine stator vane includes an airfoil extending between inner and outer endwalls, where the endwalls in the leading edge region include a vortex flow retaining chamber that opens onto the endwall surface and extends around the leading edge region with the airfoil fillet extending below the endwall surface and into the vortex retaining chamber so that the hot secondary flow will flow into the vortex retaining chamber and be mixed with cooling air supplied through cooling air supply holes. A row of exit discharge slots is connected to the vortex retaining chamber and a discharge vortex tube that extends across the endwall from one side to the opposite side to channel cooling air and hot secondary flow gas through the discharge vortex tube and into the row of exit discharge slots and onto the endwall surface.

DETAILED DESCRIPTION OF THE INVENTION

Figure 1:
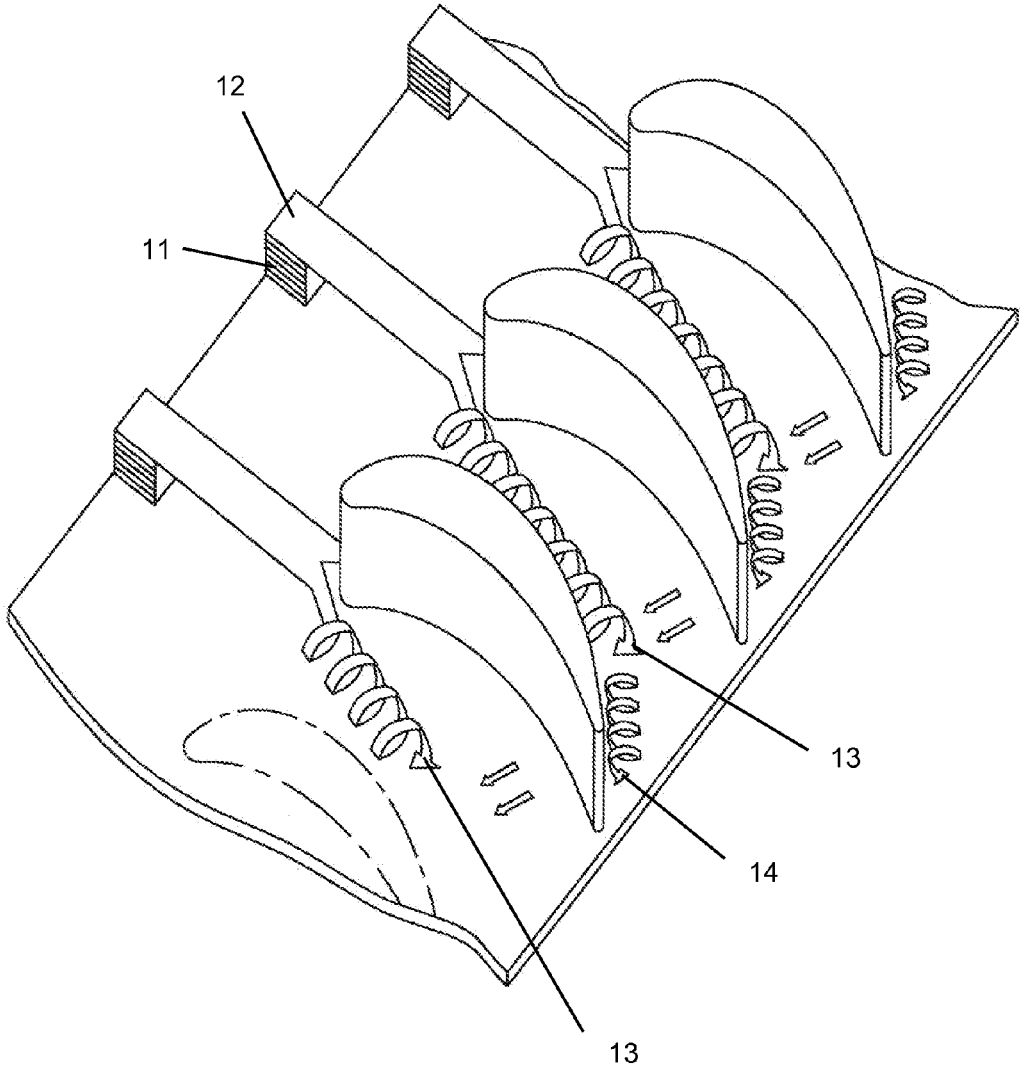
Fig 1 prior art
FIG. 1 shows a schematic view of a stator vane assembly with hot gas stream flow with vortex flow formation.
Figure 2:
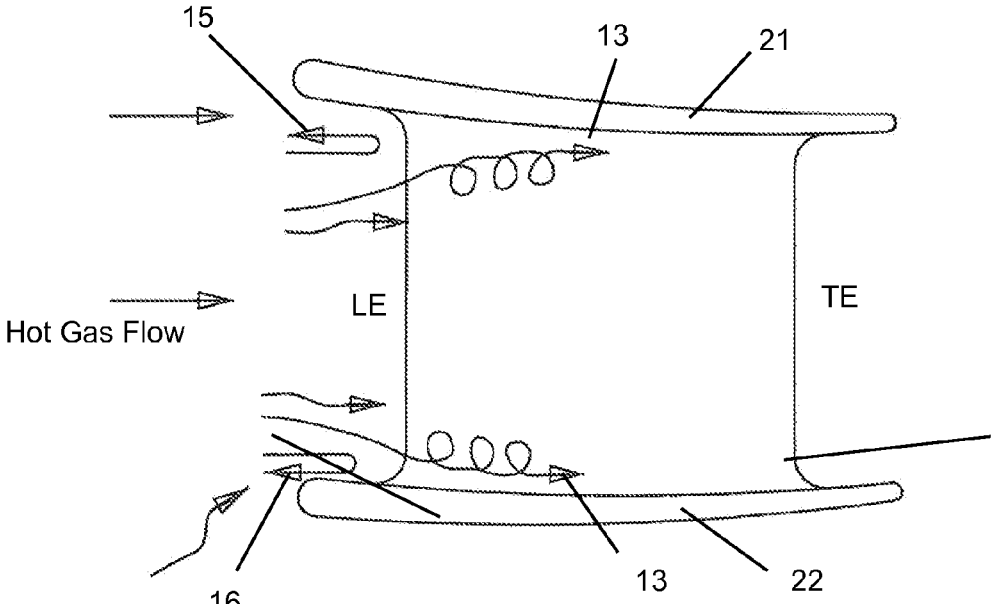
Fig 2 prior art
FIG. 2 shows a stator vane side view with forward stagnation flow on the inner endwall and the outer endwall in the leading edge region.
Figure 3:
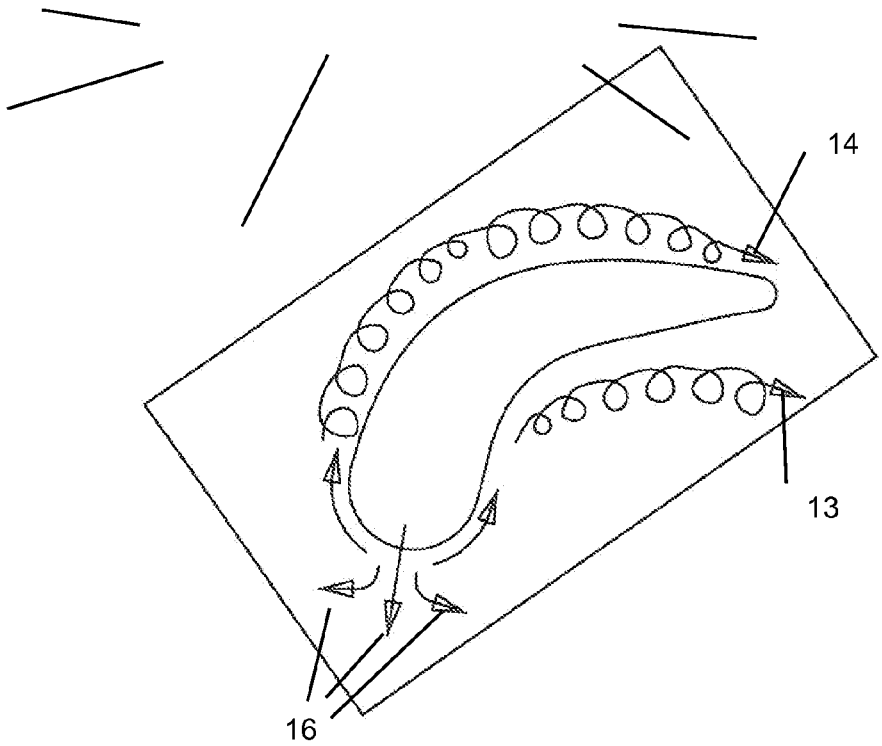
Fig 3 prior art
FIG. 3 shows a stator vane top view of the vortex flows and stagnation flows generated around the airfoil and the endwalls.

A turbine stator vane includes an airfoil with a leading edge region, in which the airfoil extends between an inner endwall and an outer endwall to form a hot gas flow path through the vane. FIG. 1 shows a top view of the vane with the airfoil 31 extending from an endwall 32. A vortex flow retaining chamber 33 is formed within the endwall in the leading edge region that wraps around the leading edge to form a horseshoe like shape. The vortex retaining chamber 33 opens onto the endwall surface. A discharge vortex flow tube 34 is formed within the endwall and extends from one side of the endwall to the opposite side and passes through the vortex flow retaining chamber 33. The vortex flow tube 34 is parallel to a front or upstream side of the endwall 32. A row of cooling air exit holes are connected to the discharge vortex tube and open onto the endwall surface on the pressure side and the suction side of the endwall 32. The vortex flow tube 34 crosses through the vortex flow retaining chamber 33 at a location in front of a stagnation line of the airfoil 31.

Figure 4:
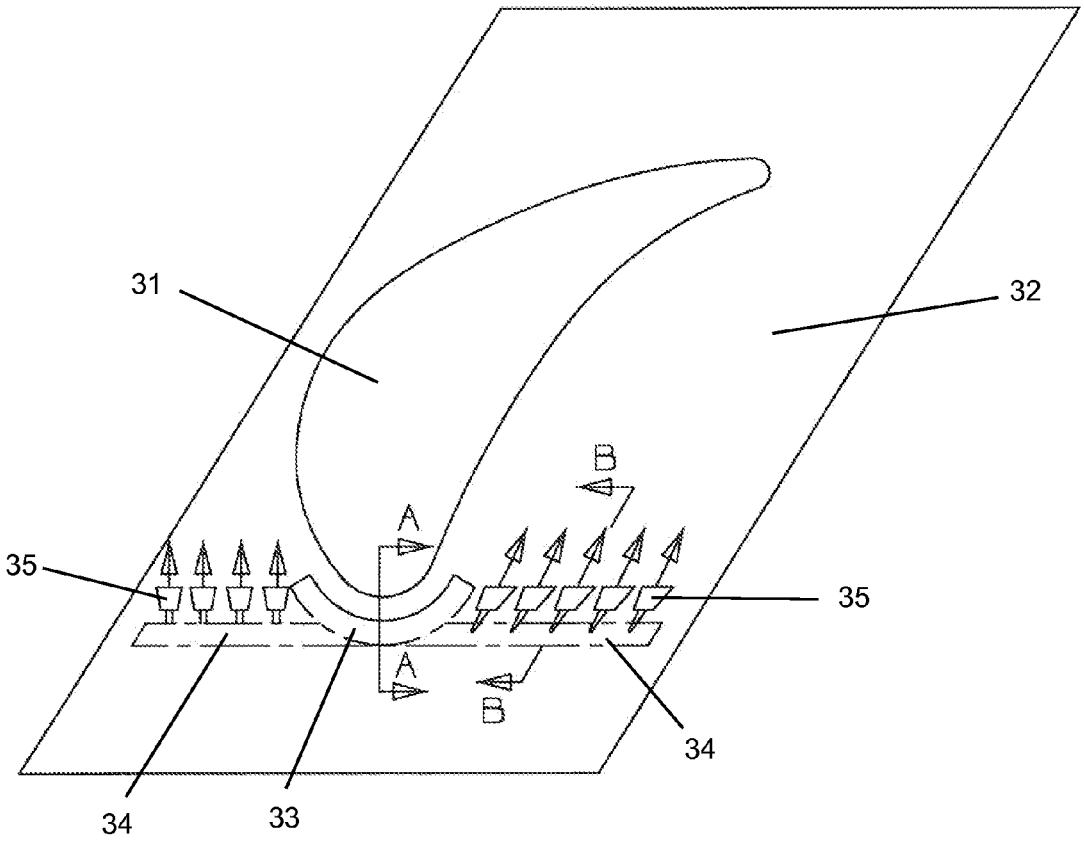
FIG. 4 shows a top view of the stator vane of the present invention with a vortex retainer chamber.
Figure 5:
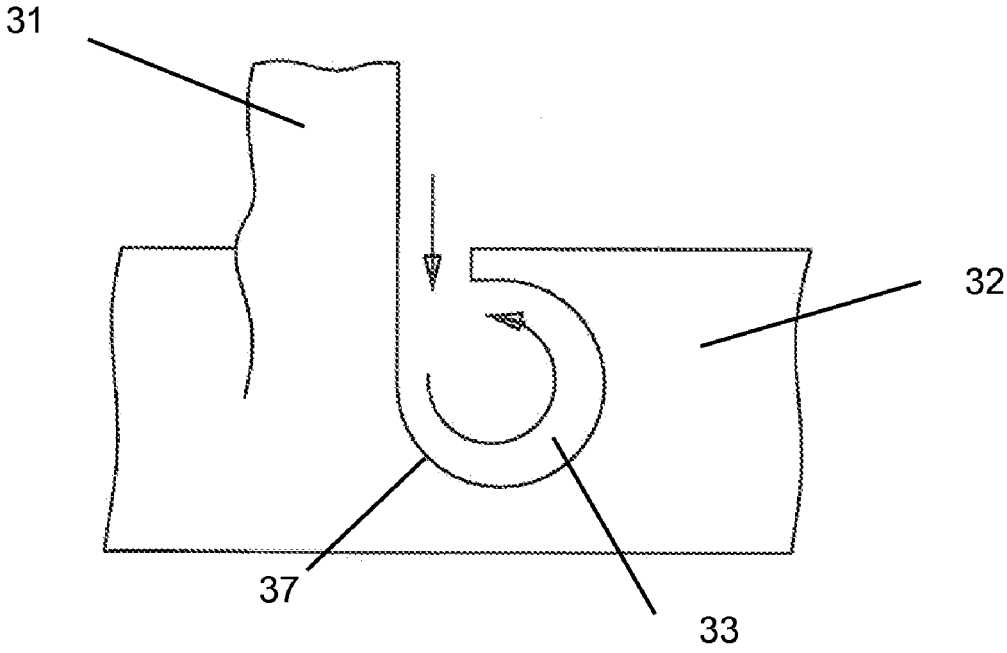
FIG. 5 shows a cross section view of the vane airfoil and vortex retainer chamber of the present invention through line A-A of FIG. 4.

FIG. 5 shows a view of the vortex flow retaining chamber 33 along the line A-A in FIG. 4. The airfoil 31 includes a fillet 37 that extends down into the vortex flow retaining chamber 33 below the endwall 32 surface. As seen in FIG. 5, the vortex retaining chamber is located below the endwall surface and opens onto the endwall surface to form a smooth transition from the airfoil surface 31 into the vortex retaining chamber 33 so that a vortex flow is formed.

Figure 6:
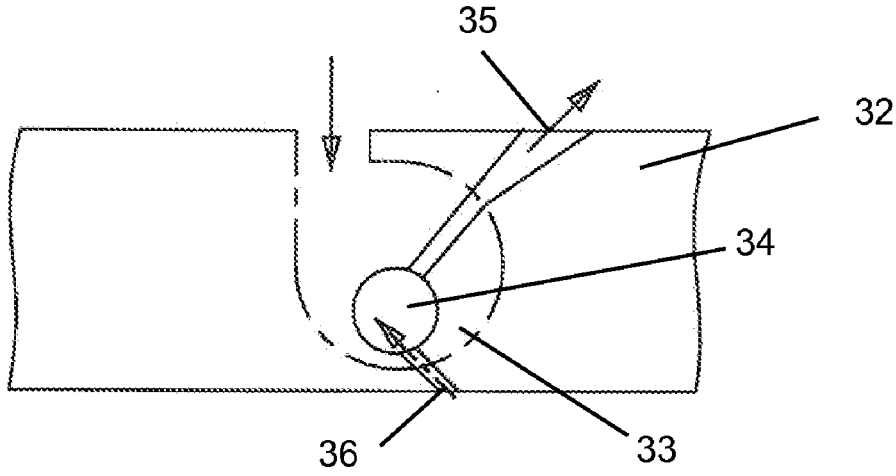
FIG. 6 shows a cross section view of the vane airfoil and vortex retainer chamber and vortex tube of the present invention through line B-B of FIG. 4.

FIG. 6 shows a cross section view of the vortex retaining chamber along the line B-B in FIG. 4. The vortex tube 34 extends through the endwall aligned with the vortex retaining chamber 33. A number of cooling air supply holes 36 connect the vortex tube 34 to a cooling air supply below the endwall and discharge the cooling air into the vortex tube 34 in a direction opposite to the hot secondary flow passing into the cortex retaining chamber 33. A number of cooling air discharge holes 35 having a diffusion section opens onto the endwall surface that are connected to the vortex tube 34. The cooling air discharge holes are slanted in a direction of the hot gas flow over the endwall 32 surface. As seen from FIG. 6, a diameter of the vortex flow tube 34 is much smaller than a diameter of the vortex flow retaining chamber 33, which is about one-half the diameter of the vortex flow retaining chamber 33.

In the vane cooling air circuit of the present invention, the hot secondary gas flow described in the prior art will flow into the vortex retaining chamber 33 and then be discharged back onto the endwall surface through the exit holes 35. The cooling air injected into the vortex tube 34 will mix with the hot secondary flow entering the vortex retaining chamber 33. The mixture of cool cooling air and hot secondary flow will then be discharged out through the exit holes 35 and onto the endwall surface to provide film cooling for the vane endwall. Both the inner endwall and the outer endwall can include the vortex retaining chamber and vortex tube and cooling exit holes described above.

Major design features and advantages of the vortex desensitization circuit design of the present invention are described below. The vortex retainer chamber design provides an improved cooling along the airfoil leading edge horseshoe vortex and airfoil fillet region.

In addition, the design also improves cooling film layer formation relative to the prior art endwall film cooling process. The elimination of channel vortex will lower turbulence level for the vane endwall which reduces the airfoil mixing losses.

Desensitization of vortex increases the uniformity of the endwall film cooling layer from the passing hot secondary gas and therefore provides a more effective film cooling for the film development and maintenance. This also establishes a durable film cooling for the vane endwall region.

A reduction of the heat load onto the airfoil fillet region and the leading edge horseshoe region is produced by containing the secondary hot gas flow vortex.

The vortex retainer chamber creates additional local volume for an expansion of the hot core gas flow. This increase volume will slow down the secondary flow as well as the velocity and pressure gradients, and thus weakens the vortex flow within the cavity to desensitize the vortex flow.

I claim the following:

1. A turbine stator vane comprising:

an airfoil extending between an inner diameter endwall and an outer diameter endwall;

a vortex flow retaining chamber formed within one of the inner diameter endwall and the outer diameter endwall in a leading edge region of the airfoil, the vortex flow retaining chamber having a horseshoe shape and opening onto a hot gas flow surface of the one of the inner diameter endwall and the outer diameter endwall, to enable a hot flow gas to enter into the vortex flow retaining chamber;

a vortex flow tube extending from one side of the one of the inner diameter endwall and the outer diameter endwall to an opposite side of the one of the inner diameter endwall and the outer diameter endwall, the vortex flow tube passing through the vortex flow retaining chamber;

a row of cooling air exit holes connected to the vortex flow tube and opening onto the hot gas flow surface of the one of the inner diameter endwall and the outer diameter endwall; and, a row of cooling air supply holes opening into the vortex flow tube to supply cooling air.

2. The turbine stator vane of claim 1, and further comprising:

the vortex flow retaining chamber includes a fillet of the airfoil that forms a smooth transition from the airfoil into the vortex flow retaining chamber below the hot gas flow surface of the one of the inner diameter endwall and the outer diameter endwall.

3. The turbine stator vane of claim 2, and further comprising:

the row of cooling air supply holes is angled to discharge cooling air into the vortex tube in a vortex flow direction opposite to a flow direction of the hot gas flow.

4. The turbine stator vane of claim 1, and further comprising:

the row of cooling air exit holes are slanted in a direction of the hot gas flow over the hot gas flow surface of the one of the inner diameter endwall and the outer diameter endwall.

5. The turbine stator vane of claim 4, and further comprising:

the row of cooling air exit holes each includes a diffusion section opening onto the hot gas flow surface of the one of the inner diameter endwall and the outer diameter endwall.

6. The turbine stator vane of claim 1, and further comprising:

a diameter of the vortex flow tube is around one half of a diameter of the vortex flow retaining chamber.

7. The turbine stator vane of claim 1, and further comprising:

the vortex flow tube is parallel to a forward side of the one of the inner diameter endwall and the outer diameter endwall.

* * * * *